US005312277A

United States Patent [19]

Selmer

[11] Patent Number: 5,312,277

[45] Date of Patent: May 17, 1994

[54] METHOD AND APPARATUS FOR POWER TRANSMISSION TO A SURFACE DRIVING PROPELLER MECHANISM AND USE OF A TURBINE BETWEEN THE DRIVING ENGINE AND PROPELLER MECHANISM

[75] Inventor: Jorgen Selmer, Nesoya, Norway

[73] Assignee: CPS Drive, Nesoya, Norway

[21] Appl. No.: 861,790

[22] PCT Filed: Dec. 12, 1990

[86] PCT No.: PCT/SE90/00823

§ 371 Date: Jun. 15, 1992

§ 102(e) Date: Jun. 15, 1992

[87] PCT Pub. No.: WO91/08946

PCT Pub. Date: Jun. 27, 1991

[30] Foreign Application Priority Data

Dec. 13, 1989 [SE] Sweden ..... 8904200-6

[51] Int. Cl.[5] ..... B63H 23/26

[52] U.S. Cl. ..... 440/75; 440/86; 192/3.31; 74/DIG. 8

[58] Field of Search ..... 440/75, 84, 86, 88; 180/337, 364, 367; 192/3.21, 3.31, 3.33; 60/347, 348, 357; 74/DIG. 2, DIG. 8, 730.1, 732.1, 655

[56] References Cited

U.S. PATENT DOCUMENTS

| | | | |
|---|---|---|---|
| 1,667,475 | 4/1928 | Kasley | 440/4 |
| 4,305,710 | 12/1981 | Schneider | 440/75 |
| 4,378,219 | 3/1983 | Tanka | 440/75 |
| 4,820,209 | 4/1989 | Newman | 440/75 |
| 5,018,996 | 5/1991 | Newman | 440/75 |
| 5,108,324 | 4/1992 | Adams | 440/75 |

FOREIGN PATENT DOCUMENTS

| | | |
|---|---|---|
| 0037690 | 10/1981 | European Pat. Off. . |
| 462590 | 7/1990 | Sweden . |

*Primary Examiner*—Andres Kashnikow
*Assistant Examiner*—Clifford T. Bartz
*Attorney, Agent, or Firm*—Larson and Taylor

[57] ABSTRACT

A method and a device for power transmission from a motor having a supercharging assembly, particularly a supercharged diesel-engine (7), to a gear (3) with a surface water driving propeller mechanism (4) mounted in a boat of the planing variety and preferably with a large propeller with a large pitch. A turbine coupling (10), which can be filled to a variable extent, is mounted between the supercharged motor (7) and the gear (3). The motor is designed to drive the pump portion (15) of the turbine coupling (10), and the turbine portion (17) of the turbine coupling (10) is connected to the input shaft (6) of the gear (3). The turbine coupling (10), when the boat is started, is emptied completely or partially, in such a way that it is at least partially disconnected from the gear. The motor is then accelerated to such a speed that the supercharging assembly of the motor (7) is connected. The turbine coupling is subsequently quickly filled with hydraulic medium, so that the propeller mechanism (4) is influenced by the substantially maximum output of the motor, caused by the supercharging assembly. When the boat has reached its planing speed, the motor speed in the desired way is reduced and/or the extent of filling of the turbine coupling is reduced, but no to a lower speed than that the boat will be propelled with a speed which is somewhat larger than the planing limiting speed. The invention also relates to the use of a turbine coupling in planing boats having gears of the above-described variety.

11 Claims, 4 Drawing Sheets

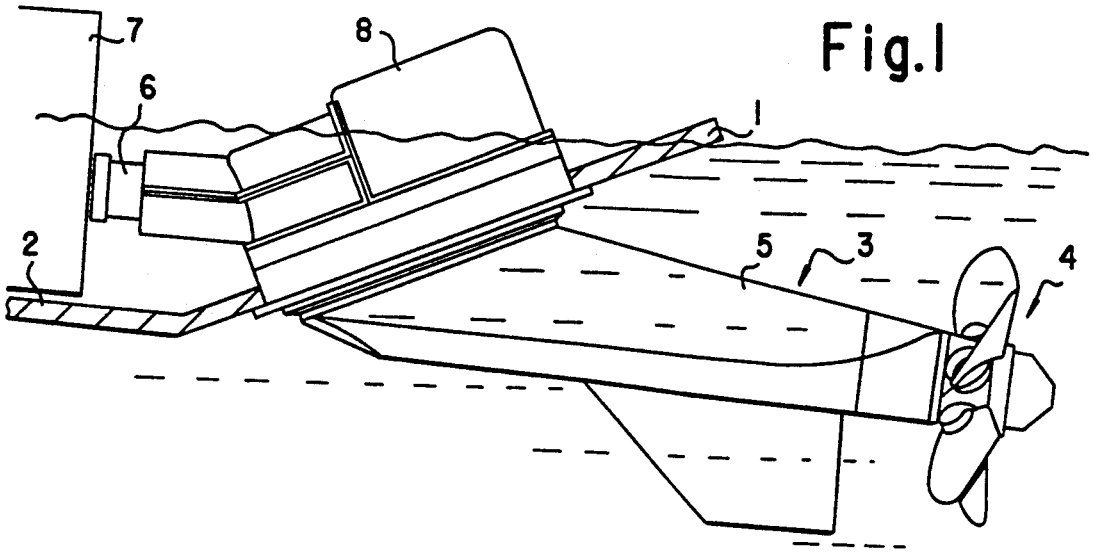
Fig.1
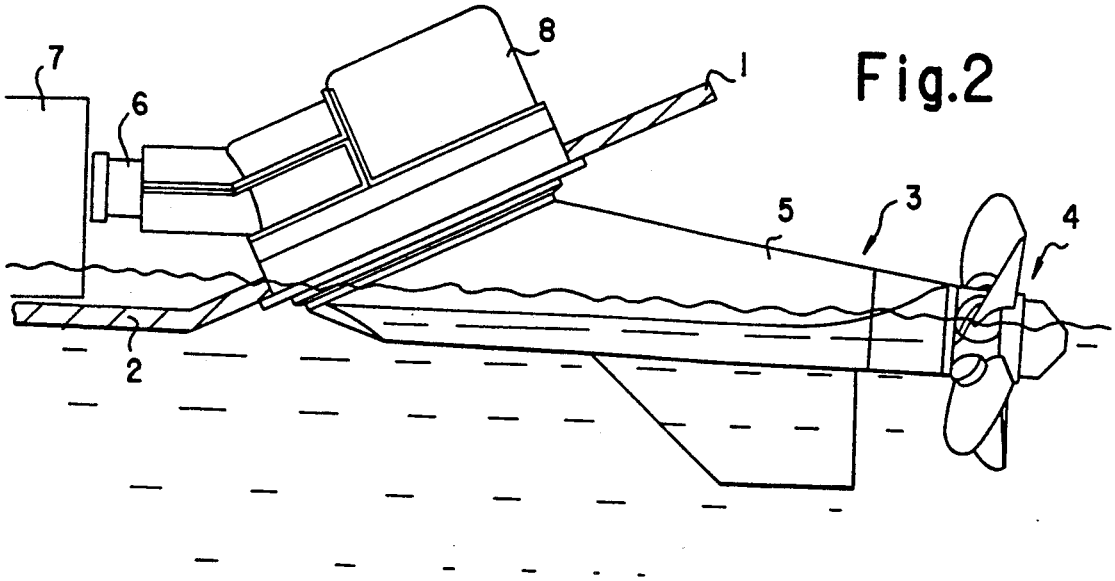
Fig.2
Fig.4
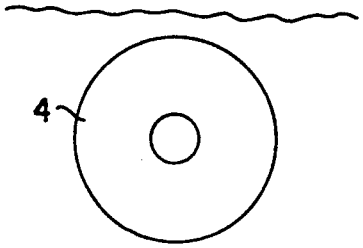
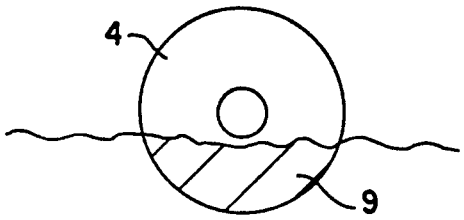
Fig.3

METHOD AND APPARATUS FOR POWER TRANSMISSION TO A SURFACE DRIVING PROPELLER MECHANISM AND USE OF A TURBINE BETWEEN THE DRIVING ENGINE AND PROPELLER MECHANISM

FIELD OF THE INVENTION

The present invention generally relates to driving systems for boats having so called surface water driving propeller assemblies, and the invention more particularly relates to such a driving system, in which the driving motor is a motor with a supercharging assembly, particularly a supercharged Diesel-motor (turbo-Diesel) or a motor having a compressor supercharger.

BACKGROUND OF THE INVENTION

A surface water driving propeller assembly is a type of boat gear, in which the gear is mounted in the stern of preferably planing boats and in which the propeller assembly with its gear body projects essentially horizontally backwards (when the boat is planing) outside the stern, and which drives a propeller with an essentially straight shaft. Gears of this type are mounted in such a way, that the gear housing, when the boat is driven at speeds above a certain minimum speed, which corresponds to the lowest planing speed, is substantially parallel with the water surface and close to the water surface and in which the propeller assembly with its propeller dips into the water with only about half its height. Some propeller blades are then positioned in water, whereas other propeller blades are being ventilated in the air above the water surface. Propellers designed for this type of gear are consequently larger and/or have a larger pitch than conventional underwater-working propellers, usually at least a 15% larger diameter and pitch, because only some of the propeller blades exert a propulsion power below the water surface, and also the propellers must rotate considerably slower than conventional underwater-working propellers in order to attain the best driving conditions. Various examples of gears with surface water driving propellers are shown in European patent specification 37.690 (Arneson) or in Swedish patent accplications 8804295-7 and 8804296-5 (Thiger).

When the boat is immobile and before it has accelerated to its planing speed, all the propeller assembly and the better part of the gear body are positioned below the water surface, and a very large force from the motor is required, if the motor is to be able to accelerate the boat up to its planing speed, at which speed the propellers will be able to start working in the desired way, particularly because the propeller assembly is considerably larger and has a larger pitch than conventional underwater-working propellers.

Gears with propeller assemblies of the surface water-driving type are very different from underwater-driving propellers, i.a. since the propeller in the planing speed works in air as much as 50–70% and is considerably larger and usually has a considerably larger pitch than the corresponding underwater-working propellers and since the propeller drives the boat through a pressure force from the rear side of the propeller, while conventional underwater-working propellers propel the boat through a suction force on the front side of the propeller in substantially the same way as a sailing boat, when the wind comes ahead to port, is propelled through the suction force from the front side of the sail This is the main reason for the absence of a cavitation and a suction downwards of air from the water surface as far as a surface water-driving propeller goes, which is quite common as to conventional underwater-working propellers. Thus, it is possible as to surface water-driving propellers, already when the boat is immobile, to exert an initial force on the propeller, which corresponds to a maximum torque from the motor. In this way a boat with a surface water-driving propeller can be accelerated very strongly, and in practice such propeller assemblies, in comparison with underwater-driving propellers, prove to attain a speed increase of as much as 30–40%.

When motors, particularly Otto-engines, without turbo-charging assemblies are used, the required large initial force can often be obtained through a large gas input, but when using driving motors provided with supercharger assemblies such as turbo- or compressor-charge-assemblies, particularly supercharged Diesel-engines (turbo-Diesel engines), problems arise, which have so far been very difficult to solve. The Diesel-engines to be sure normally have a fairly small speed range and a low maximum top speed and have a relatively weak acceleration capacity from low speeds. Supercharged Diesel-engines also to be sure do not obtain their higher power range, made possible by means of the turbo-assembly, before the supercharger assembly has been connected, and this is not done before the speed is relatively high. Thus, when Diesel-engines are used, particularly supercharged Diesel-engines, in boats with gears of the above-mentioned surface water-driving type, the view has so far been that it is necessary to use an oversized engine, which is able to accelerate the boat to its planing speed within a reasonable period of time, or that it is necessary to use other, maybe expensive and complicated solutions in order to obtain a high driving motor output already from the start.

Also as far as underwater-driving propellers go, the propeller to be sure working constantly and in its entirety against water, the corresponding problem may arise but not to the same extent as in the case of surface water-driving propellers, where the propeller works against water only from the immobile condition of the boat and up to its planing speed, while the active surface of the propeller against water when the speeds are higher than the planing speed is only 40–60% of the total propeller-surface, while the remaining part of the surface works in air and substantially without any reaction requirement. As far as such underwater-driving propellers go, the propeller proportionally being smaller than surface water-driving propellers and allowed to work with a considerably higher speed than surface water-driving propellers, the above-mentioned problems could be solved by feeding air downwards to or allowing air to be sucked downwards to the propeller, in order to make the propeller "spin" and with a maintained high speed accelerate the boat to its planing speed. In certain cases this problem has also been solved by equiping the boat with an undersized propeller in order to allow a "spinning," when a cavitation and an air suction downwards take place.

Swedish document 451.449 (Brunswick Corporation), laid open to public inspection, describes a system designed to increase the acceleration of a boat by connecting between the motor and the gear a torque-boosting hydrodynamic torque converter. Such a torque converter allows a certain slippage between the pump and the turbine, often a slippage of almost 20%, which allows an acceleration of the motor, before the propeller starts to drive fully, and in this way the motor will already from the start of the acceleration cycle have a speed, which at least to some extent has approached the highest output-speed of the motor. The slippage in the torque converter is limited i.a. by the use of stationary guide rails and by the shape of the pump and turbine blades and it allows only a certain limited motor speed increase, before the successively increased hydraulic pressure in the torque converter makes the propeller drive with a substantial force. However, due to the comparatively large slippage of almost 20% between the pump and the turbine and the guide rails respectively a complete motor output on the propeller cannot be attained, and due to the risk of overheating etc. also such a slippage cannot be allowed for an extended period of time Thus, the hydrodynamic torque converter in the above-mentioned public inspection-document is according to this document designed with a lockable mechanical coupling, a so called lock-up clutch, which is connected when the motor reaches a certain predetermined speed and is disconnected when the motor speed is lower than this predetermined speed.

A device of the above-described type has some drawbacks, which make it unserviceable for gears with surface water-driving propellers and for motors of the type, which requires an almost maximum speed, before the motor output starts being transmitted to the propeller, e.g. motors having a surcharge assembly, so called turbo-motors, and this is particularly true for Diesel-engines but also for Otto-motors. In boats with such motors, for which the motor output has been calculated with regard to the maximum output at a high motor speed, said device cannot be used at all, since this high motor speed cannot be obtained before the driving force is transmitted to the propeller. Also, the device is complicated and expensive, there is a great risk of overheating and an overheating of the hydraulic medium due to the extensive slippage, special pump assemblies are required for a connection and a disconnection of the lock-up clutch, and there is a risk of slippage also in the lock-up clutch at high motor speeds and outputs.

SUMMARY OF THE INVENTION

In accordance with the present invention the above-described problem can be solved in a surprisingly simple and very efficient way, namely by connecting between the motor, e.g. the turbo-Otto-engine or the turbo-Diesel-engine and the gear a simple turbine coupling of a type, which comprises only a pump wheel and a turbine wheel, which turbine coupling can be filled and emptied respectively successively in a short period of time, also during a driving condition, and which turbine coupling can be driven in any filling condition, substantially between 0 and 100%, and which in its emptied condition brings about a substantially total disconnection between the motor and the gear, and which in its filled condition causes an extremely small slippage between the motor and the gear, normally merely a slippage of 1.5–3%, which slippage is so insignificant that it does not cause any overheating problems.

A turbine coupling is fundamentally different from a torque converter in several respects, i.a. since the turbine coupling works because of the kinetic energy of the hydraulic medium, while the torque converter works because of the pressure energy of the hydraulic medium; the turbine coupling has a very minor slippage, usually only about 1.5–3%, whereas the torque converter usually has a slippage of at least 20%, and consequently it usually must be combined with a lock-coupling in order to make it serviceable; the turbine coupling brings about a direct hydraulic torque transmission because of a simple rotary liquid flow, whereas the torque converter brings about a power amplification with a gear reduction because of a complex curved liquid flow, brought about by the blades of the pump portion and the turbine portion, which blades are designed in a complicated way, and because of the use of stationary guide rails. A torque converter cannot at all solve those problems, which were the cause of the present invention, whereas a turbine coupling solves those problems in a surprisingly efficient way.

By using such a simple turbine coupling it is possible to take the following steps:

- When starting the motor the turbine coupling is completely emptied, and consequently the motor works substantially without any resistance;
- The motor is accelerated to its maximum or almost maximum speed, the surcharge assembly or turbo-assembly being connected;
- The turbine coupling is only then filled up with hydraulic medium, a torque being transmitted, to the propeller very quickly, which torque corresponds to almost the entire motor output, and consequently the boat accelerates rapidly to its planing speed;
- The motor speed is subsequently reduced in the desired way as long as the boat is driven at a speed faster than the planing speed.

The filled turbine coupling works as an almost directly acting coupling, and it can stay filled until the boat speed is reduced to the displacement speed, when the acceleration-method may be repeated.

A surface water-driving propeller should, as has been mentioned above, be large, have a large pitch and be driven with a relatively low speed and consequently it is suitable to mount a reduction gear, possibly a reduction gear having a built-in reversing gear, between the turbine coupling and the gear. The reduction gear suitable is designed in such a way, that the propeller, when the motor runs at full speed, has a speed of about 1000–2000 r/m or rather 1,200–1,500 r/m. The reversing gear suitably is a mechanical gear or alternatively can be designed as a hydrodynamical torque converter, which is directly connected to the hydrodynamic coupling and which is used solely as a reversing gear. When the boat is run in the forward direction, the torque converter is not used at all and by-passed. By means of such a device it is possible to directly from a full speed forwards connect the torque converter to a full output backwards, the high motor speed being maintained.

Also, by using a hydraulic coupling with a variable filling and a surface water-driving propeller mechanism, which besides has propeller blades with a variable inclination, it is quite possible to completely dispense with a reversing gear and to connect the driving motor directly to the turbine coupling, e.g. via a gear belt. When the hydraulic coupling has been emptied, it does not transmit any motor output to the gear and the propeller then works as an ideal freewheel coupling, the propeller being immobile. An additional advantage of using propellers having blades with a variable inclination is that when the inclination of the propeller blades is varied, the pitch will vary and consequently also the pulling power of the propeller and the load of the motor respectively, which is particularly advantageous for boats, which carry loads, the weight of which varies considerably. Also, by means of this device an additionally improved driving economy can be attained. Also, it is possible, if propeller blades with a variable pitch are used, to run the boat at any low speed, e.g. down to 1 knot or lower, and consequently the boat can be used also for purposes, e.g. for fishing, which it normally is impossible to do with boats, which often has a minimum idling speed of 4–5 knots or even higher.

The reduction of the motor speed to a suitable gear speed for the propeller mechanism can e.g. be achieved by means of a belt coupling or in a corresponding way.

BRIEF DESCRIPTION OF THE DRAWINGS

The invention will now be described in more detail, reference being made to the accompanying drawings. FIG. 1 shows fragmentarily a so called planing boat, which is provided with a gear and a surface water-driving propeller, shown in a lateral view, the boat having a displacement position. FIG. 2 shows in a corresponding way the same boat in its planing position. FIG. 3 shows the propeller in the driving unit schematically, when the boat is immobile, viewed from behind; and FIG. 4 shows in a corresponding way the propeller from behind, when the boat is running with a planing speed.

DETAILED DESCRIPTION OF THE PREFERRED EMBODIMENT

Figure 5:
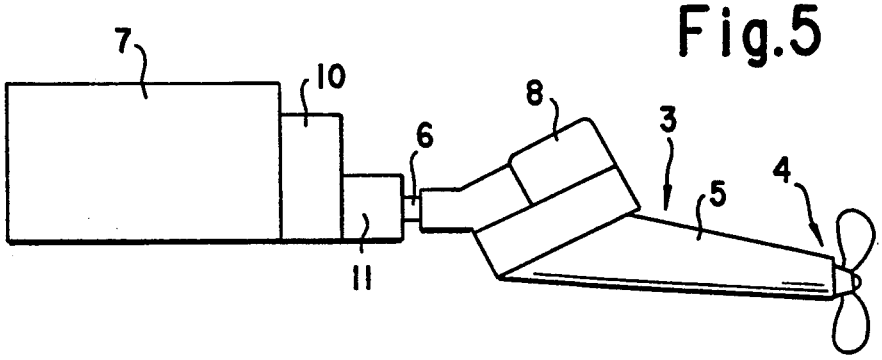
FIG. 5 shows schematically an embodiment of a driving unit according to the present invention.

Thus, FIG. 1 shows a boat, in stern 1 of which and close to bottom 2 of which a gear 3 having a surface water-driving propeller 4 is mounted. The stern has in this case an inclination of only about 20–30° and is adapted to a special type of gear, a so called CPS-gear. Gear 3 extends with a gear unit 5 substantially straight outwards and rearwards from stern 1, and it is with an inner clutch 6 connected to a driving motor 7, in the present case an inboard motor, particularly a Diesel-engine having an overcharge unit (turbo-Diesel). Between clutch 6 and gear unit 5 the gear is provided with a device 8 designed to pivot the gear in the horizontal plane and to tilt gear unit 5 in a vertical plane (tilting). Motor 7 transmits its driving force to propeller 4 by means of a substantially straight drive shaft, which includes two universal joints and a conventional "slide"-coupling in order to allow a transmission of force also when the gear unit is steered and tilted. For the rest the gear is designed in a known way and will not be described in more detail.

When the boat is immobile and before it has been accelerated to a certain minimum speed, propeller 4 is positioned completely below the water surface, as is shown in FIGS. 1 and 4. However, as the speed increases, the boat is elevated, particularly its stern, and consequently gear 3 and its propeller 4 are elevated towards the water surface, and when the boat has accelerated to a planing speed, only a portion 9 of the active propeller surface dips into the water (see FIG. 3). This active surface 9 is maintained substantially unchanged also at higher speeds of the boat.

When the boat is started, all the shown five propeller blades are working against the water and a very large driving power from the motor is required to accelerate the boat to its planing speed, particularly since the propeller blades on surface water-driving gears are substantially larger and usually also have a considerably steeper pitch than the propeller blades on the corresponding conventional underwater-driving propellers, e.g. on gears of the so called Z-type or the INU-gear-type. Up to the moment when the boat has been accelerated to its planing speed, as is shown in FIGS. 2 and 4, the reaction force from the water decreases successively, and a proportionately smaller amount of force for the propulsion of the boat is required.

The acceleration of the boat to its planing speed has, as has been mentioned above, created problems with already known devices of this type, particularly when Diesel-engines are used, which usually have a relatively small speed range, and above all when surcharged Diesel-engines (turbo-Diesel-engines) are used, which as is known require a comparatively high speed before the surcharge unit is connected and the Diesel-engine reaches its higher power range by means of the turbo-unit.

Figure 6:
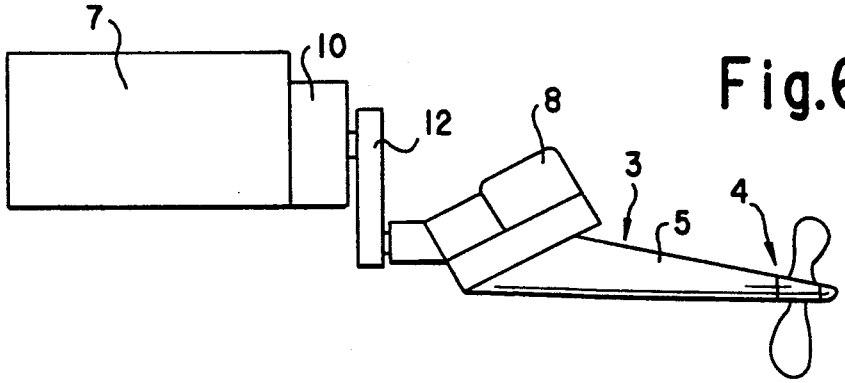
FIG. 6 shows another embodiment of the driving unit.

This problem is solved according to the invention, as is shown schematically is FIGS. 5 and 6, by connecting a seemingly not required but actually most valuable turbine or turbine coupling 10 between the output shafts of motor 7 and gear 3.

A turbine coupling is a simple and service-reliable hydraulic coupling with a variable filling and it can be driven with any degree of filling between 0 and 100%. When the filling is 0%, the pump blades and the turbine blades do not touch each other at all and slipping between the blades is in this case practically 100%. Thus, the turbine coupling creates practically no resistance at all against an acceleration of the motor. When the filling is complete, the slippage of the turbine coupling is very small, normally only 1.5–3%. Thus, by filling the turbine to any degree of filling between 0 and 100% any required slippage can be obtained, and the coupling is a most flexible coupling, which is particularly useful for marine purposes.

Thus, turbine coupling 10 has the advantage that the input part with the pump blades can be accelerated to a high speed with an empty turbine, before the filling of the coupling is started and the output of the turbine blades starts offering a substantial resistance corresponding to the water reaction force on the propeller blades. Thus, surprisingly enough we found that it is entirely possible, by using a conventional turbine coupling, to attain a quick and efficient acceleration of a boat having surface water-driving propellers and equipped with one or several non-oversized surcharged Diesel- or Otto cycle-engines from an immobile position to its planing speed, which has not been possible with already known devices. Thus, it is possible when the boat is immobile to accelerate the Diesel-engine to such a speed that the surcharge unit is connected before the filling of the turbine coupling is commenced. This avoids the water reaction force against the propeller or the propellers reaching such a large value that difficulties otherwise would have been experienced when accelerating the boat to its planing speed. An additional advantage of using a turbine coupling having a variable filling is that it is possible to continuously and constantly cool the hydraulic medium for the coupling, every risk of a superheating being eliminated.

A practical test:

In a practical test two different driving systems on the same boat and the same motors were examined. The boat was a 35 feet planing plastic boat equipped with two turbo-Diesel-engines, mounted in parallel, each with 340 hp and with a maximum speed of 2,000 r/m. The entire boat, including motors and gear, weighed 10 tons. A. A conventional straight shaft with underwater-driving propellers:

In this first test the boat was equipped in a conventional way with straight shafts and underwater-driving propellers, which in order to accelerate the boat to its planing speed had an optimal diameter of 15" and a pitch of 17". From the starting condition the gas input had to be done comparatively slowly in order to avoid an overload of the motor and a discharge of black Diesel-smoke caused thereby, and only after 20–30 seconds had the boat been accelerated to its maximum speed, the motor speed reaching 2,400 r/m and the speed with the existing load being 28 knots.

B. Hydraulic coupling as well as a gear with surface water-driving propeller:

In a second test with the same boat and the same motors as in case A the boat was equipped with gears with surface water-driving propellers (see the above-mentioned known publications ) as well as with a turbine coupling, made by Voith, between each motor and each gear. Each propeller had in this case a diameter of 29" and a pitch of 39"; and the hydraulic coupling was provided with a conventional three way valve, by means of which the coupling quickly could be filled and emptied respectively, to any suitable degree of filling. Between the turbine coupling and the propeller shaft was used a reduction gear (2:1) of the gear belt variety. In all the following test runs the boat was started from an immobile condition on an open water surface, the wind and wave conditions being the same as in case A, and was accelerated to its full speed.

B1. In a first trial run a) the hydraulic coupling was emptied completely of oil, the slipping increasing to almost 100%, b) the motors were accelerated to a maximum speed, which was 2,600 r/m; c) in direct connection with this the three way valve to the turbine coupling was opened up and consequently the turbine coupling was filled completely. The motor speed decreased during the acceleration, when the turbine coupling was being completely filled, to not lower than 2,300 r/m and increased again at full speed to about 2,400 r/m, which corresponds to a propeller speed of 1,200 r/m. It was observed that the boat in this case was accelerated very strongly and yet the motors emitted no black Diesel-smoke whatsoever, and the boat had already after about 10–12 seconds accelerated to its full speed, which in this case was 38 knots, namely 10 knots or 36% faster than in case A. When the boat had accelerated to above its planing speed, the motor speed and the speed of the boat could be lowered as we saw fit to almost the planing limit speed of the boat.

B2. In a second trial run the boat was started with a completely filled turbine coupling and with the two Diesel-engines at full speed. In this instance the motor speed increased to only 600 r/m and the boat could not be accelerated to a higher speed than 6 knots. A thick black Diesel-smoke filled the environment.

B3. In a third trial run the boat was started with its turbine coupling filled to about 50% and also in this case with the two motors at full gas input. In this case the boat dragged itself slowly up to about 18 knots, a thick Diesel-smoke being emitted during all the acceleration step. The acceleration phase up to 18 knots took about 30–40 seconds. Only after a complete filling of the hydraulic coupling was the speed increased to 38 knots.

The tests showed that it is entirely possible to, in a very brief period of time, accelerate a planing boat, under the above described circumstances, to its full speed; that this can be done without any practical and technical problems or drawbacks; that the acceleration can be done without any overload of the motors, without any overheating of the turbine coupling, and without any black Diesel-smoke being emitted; that the acceleration can be done without any oversizing of the motors; that it is possible to use an ideal non-undersized propeller; and above all that the driving unit allows a surprisingly large increase in the efficiency of the device.

The driving unit suitably includes a reduction gear, which reduces the motor speed, transmitted by means of the turbine coupling, to a suitable propeller speed, and also the driving unit ought to include a reversing gear in order to accomplish deceleration and reversing functions.

In FIG. 5 it is shown how between turbine coupling 10 and gear 3 a mechanical combined reduction and reversing gear 11 has been mounted, and how clutch 6 of gear 3 has been connected directly to gear 11.

In FIG. 6 another embodiment for the same purpose is shown. In this case the reversing gear has been mounted in a unit connected to the turbine coupling, and the reduction gear comprises a belt coupling 12, which extends between the output shaft of turbine coupling 10 and the input shaft of gear 3, the belt disks on the coupling and the gear respectively determining the gear ratio between motor 7 and gear 3.

Turbine 10 can be any known type of turbine and as an example the turbine couplings manufactured by the company Voith can be mentioned, e.g. the couplings of type TP or TD, which can be filled to a variable degree.

Figure 7:
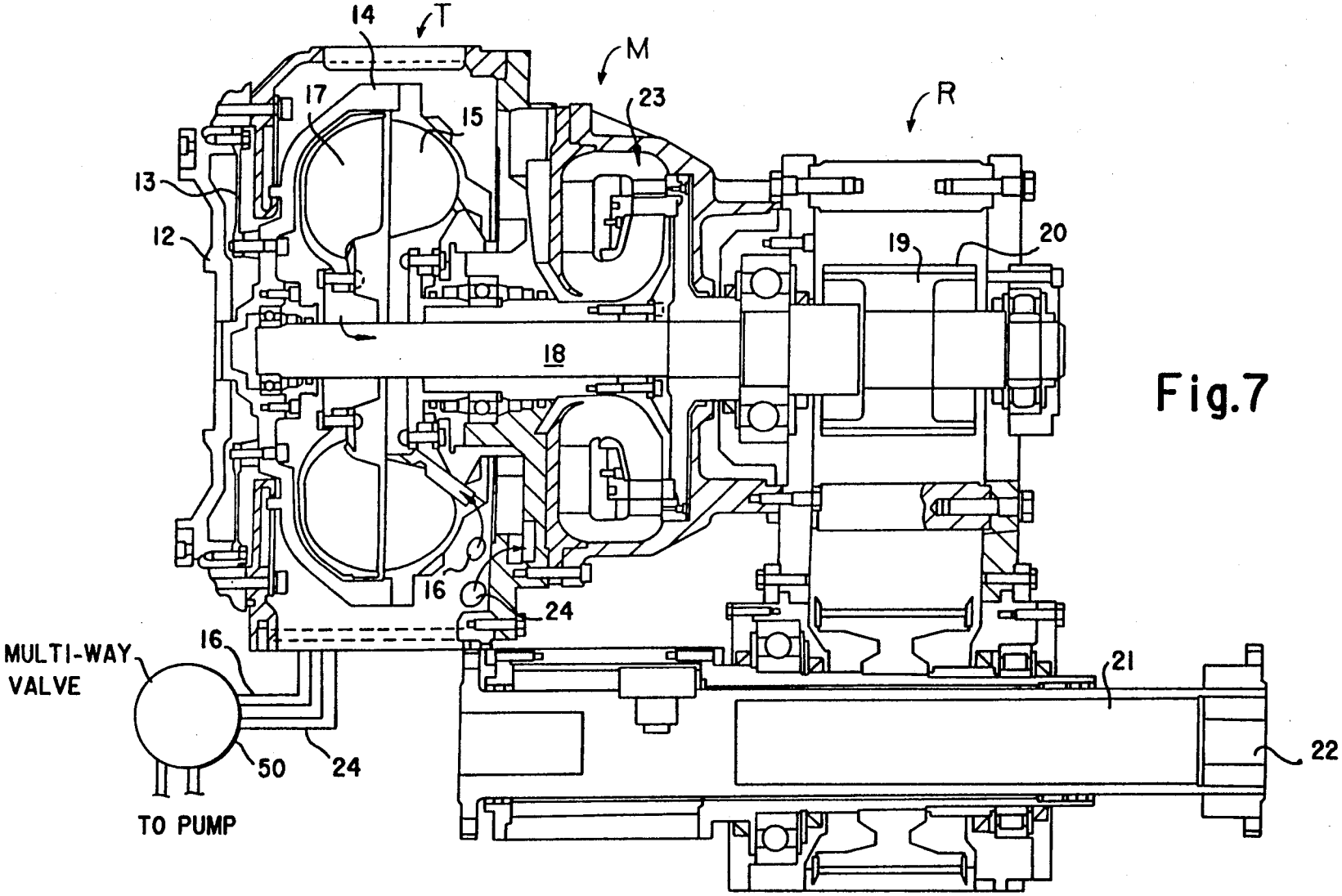
FIG. 7 shows a vertical section through a possible example of a turbine coupling having a reversing gear, which device advantageously can be combined with the invention.

In FIG. 7 is shown, as a feasible example of a useful device, a turbine coupling in a vertical section, which turbine coupling T in this specific case is connected to a reversing coupling in the form of a hydrodynamic torque converter and a reduction gear of the gear belt variety. Turbine coupling is connected to balance wheel 12 on motor 7 via an elastic force transmission disk 13, which is secured by screws to rotary interior casing 14 of the pump ring in the coupling, in which pump blades 15 are mounted. Pump blades 15 (part of a pump portion) are fed with a pressure medium from a hydraulic pump (not shown) through a schematically shown conduit 16, which is connected to a valve, designed to fill and empty respectively the turbine coupling. The hydraulic medium issuing from pump blades 15 influences turbine 17 (part of a turbine portion) through the mass flow, which are connected to output shaft 18 of the coupling. Output shaft 18 of the turbine coupling is in this case designed with a gear belt-reduction gear, which comprises a gear belt disk 19, which by means of a gear belt 20 cooperates with a second larger gear belt disk 21, which in its turn is mounted on output shaft 22 of the reduction gear. This output shaft 22 is directly connected to input coupling 6 of gear 3.

In order to allow a deceleration and reversing function boat gears are normally provided with a conventional mechanical reversing gear or combined reduction and reversing gear, as is indicated with gear 11 in FIG. 5. However, in the embodiment shown in FIG. 7 is a hydraulic reversing gear 23 in the form of a known type of hydrodynamic torque converter connected to turbine coupling and to reduction gear. The reversing gear works in the opposite rotational direction against the hydraulic coupling and it is activated solely during reverse motion, whereas it is completely disconnected during forward motion, which is done exclusively by influencing the turbine coupling. The reversing gear is fed with pressure medium from a hydraulic pump (not shown) through a schematically shown conduit 24. Conduits 16 and 24 are connected to a multiple-way valve, which empties one of the two conduits when the other one is fed with the pressure medium and vice versa, and in this way the turbine coupling and the reversing gear respectively can be connected according to what is desired and without being influenced by the other part.

Figure 8:
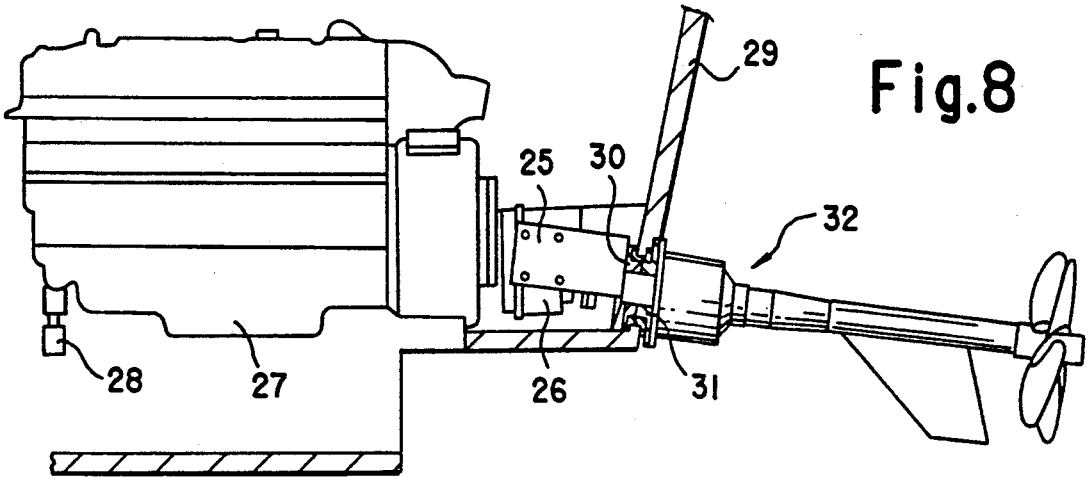
FIG. 8 shows how the invention can be used jointly with gears having surface water-driving propellers of type "Arneson.
Figure 9:
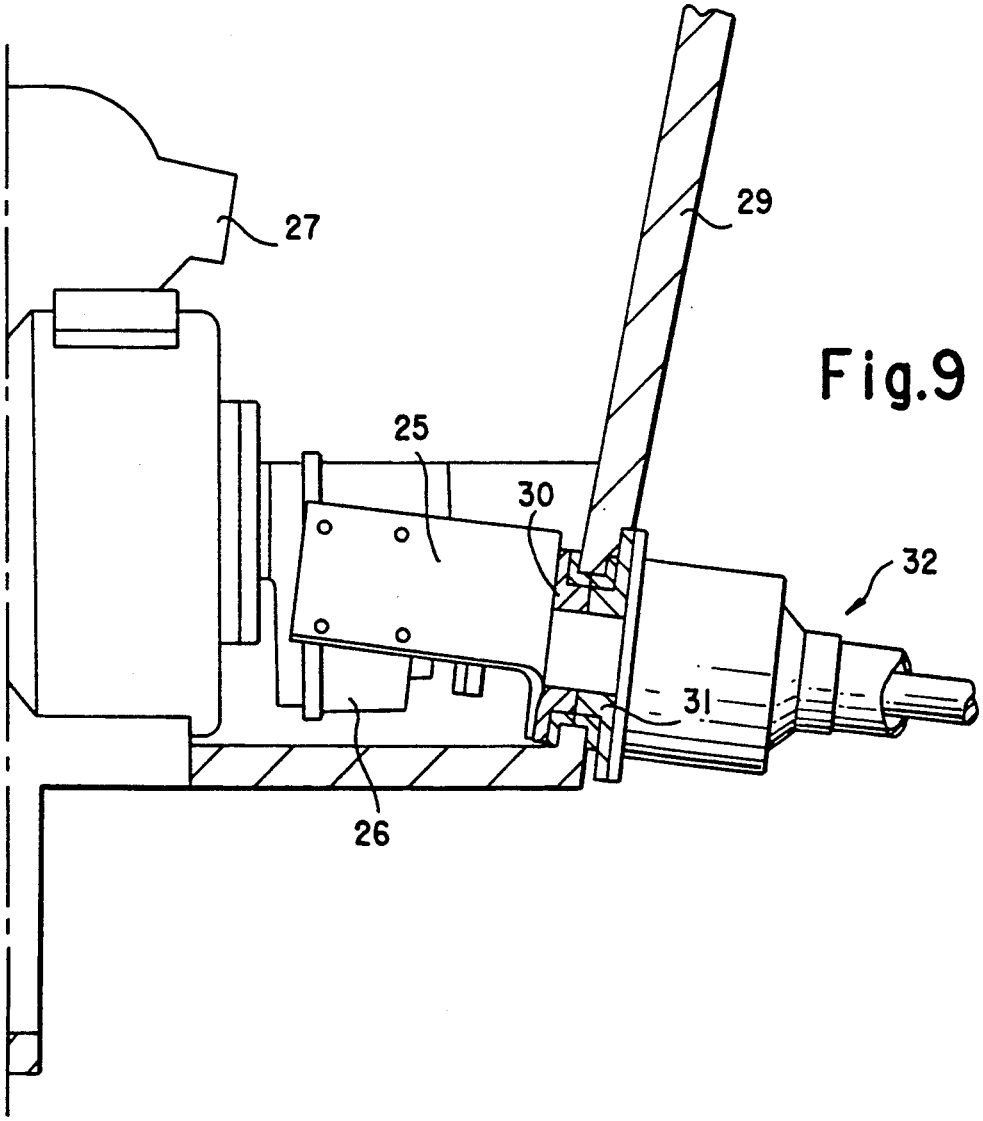
" and FIG. 9 shows a detail of the same device.

In FIGS. 8 and 9 is shown an application of the invention, in which the motor-turbine coupling-assembly according to the invention, combined with a gear of the so called Arneson-type(shown in EP 37.690), is used in an ordinary boat body, the stern of which is inclined in relation to a horizontal plane by 83° and the stern can have another inclination than perpendicular to the output shaft of the motor assembly In this case the following steps are taken:

- The motor assembly is provided with a U-shaped support 25, which extends backwards and is attached to reduction gear 26, and which serves as a rear motor support, designed to suspend motor 27 between a front motor bracket 28 and rear support 25;
- With the aid of the axis of the output shaft of the gear box a small hole is drilled in stern 29 concentrically in relation to the output shaft of the motor;
- An extension tube (not shown) is placed around the output shaft of the gear box in order to form a guide tube for the ensuing machining;
- Their machining consists of arranging milling tools in two steps, on the guide tube, and in the first step there is from the inner side a plane circular contact surface milled on the inner side of the stern, exactly perpendicular to the output shaft of the gear box, and in the second step there is from the outer side a similar plane circular contact surface milled, care being taken to mill off as small an amount of material as possible, i.e. to make the inner milling tool mill off material only between the upper edge of the central hole and to make the outer milling tool mill off material only above the lower edge of the central hole;
- The milling tool and the extension tube are removed;
- A rubber packing 30, whole or divided, having a U-shaped cross-section, is inserted into the central hole and covers in this way the outer and the inner side as well as the intermediate transverse edge;
- A guide bushing 31 is inserted into rubber packing 30 and its inner side corresponds to the mounting dimension of the mounted gear 32; and
- Gear 32 is inserted into guide bushing 31 and adjacent the output shaft of reduction gear 26 and is fastened by means of screws to stern 29 in the usual way.

This method allows a mounting of the shown gear on boats, in which the motor perhaps has been positioned in varying angles in the boat body, or in which the stern has a rather varying inclination.

Figure 10:
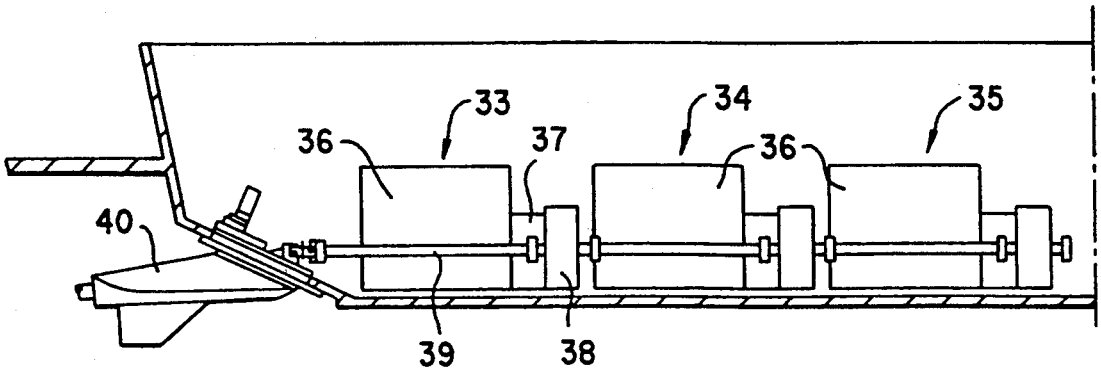
FIG. 10 shows how the invention can be used, when a plurality of motors are combined, mutually coupled in a row, after each other, to one, common longitudinal shaft.

FIG. 10 shows another application of the invention, in which three motor units 33, 34, 35, each comprising a motor 36, a turbine coupling 37 and a reduction gear 38, have been mounted in alignment after each other and been connected to a common longitudinal shaft 39, which constitutes the input shaft of gear 40. In the same way an optimal number of motor units can be connected to output shaft 39. The output shaft can be positioned anywhere below or, as is shown in FIG. 10, beside the motor units. A device of this type has a plurality of advantages:

- It is possible to position the motor units in a suitable way, e.g. distributed along the entire length of the boat or in another way, and achieve a perfect weight distribution in the boat;
- An extended but comparatively thin motor unit system is obtained, which can be mounted also in narrow spaces, e.g. close to the keelson of the boat;
- It is possible to use in a certain motor unit system an optional number of the mounted motors, because each motor unit can be entirely disconnected by a simple emptying of turbine coupling 37, the turbine coupling forming a perfect freewheel having almost no resistance;
- It is possible, when the load is minor, to disconnect one or several motors by simply emptying the turbine coupling and to drive the boat by means of only the rest of the motors;
- It is possible to use simple and inexpensive standard motors in order to assemble a strong motor unit system instead of mounting just one large and powerful motor, which usually proves to be considerably more expensive than the multiple integrated motor units;
- The service and maintenance will be inexpensive and simple;
- The access to each motor unit for service and maintenance is satisfactory;
- It is possible, in a simple way and by means of simple lifting tools, to lift a motor out of the boat and send it to a factory or shop for service or repair, the boat in the meantime using the remaining motors;
- It is possible to connect motors of different types and having different outputs to the common output shaft without the motors influencing each other in any way; and
- It is possible, by varying the degree of filling of the turbine couplings, to adjust the propulsion conditions to all kinds of occurring circumstances; etc.

Thus, the present invention relates to a method of transmitting power from a motor having an overload assembly, particularly an overloaded Diesel-engine, a so called turbo-Diesel-engine, to a gear with a surface water-driving propeller mechanism and in a planing motor boat, in which method:

- A turbine coupling, preferably having a degree of filling which can be varied from 0 to 100%, is connected between the motor and the gear and the pump element of the turbine coupling is driven by means of the turbo-motor;
- The turbine element of the coupling is connected to the input shaft of the gear;
- The turbine coupling is completely or partly emptied before a starting;

- The motor is accelerated to such a high speed, without any considerable resistance from the water, which acts on the propeller mechanism, that the overload assembly of the motor is connected: and
- The turbine coupling is filled completely or partly and consequently the motor will, with its preferably full output, achieved by means of said overload assembly, act on the propeller via the turbine coupling.

The invention also relates to a device designed to carry out the method and in a driving system comprising a motor, particularly a Diesel-engine, with an overload assembly and an outboard gear with a surface water-driving propeller mechanism having a large and comparatively slowly rotating propeller, a turbine coupling, which can be filled in a variable way, having been mounted between the turbo-motor and the gear with the propeller mechanism, which turbine coupling can be emptied and refilled so quickly, that the turbo-motor can be accelerated to such a speed, that the overload assembly has been connected, before any important reaction force has been obtained from that water, which is influenced by the propeller-mechanism.

The present invention also relates to the use of a turbine coupling in driving means designed for planing boats and comprising a motor, particularly a Diesel-engine, with an overload assembly and an outboard gear having a surface water driving propeller mechanism and in which the turbine coupling can be emptied and refilled so quickly, that the motor can be accelerated to such a speed, that the overload assembly has been connected before any considerable reaction force from the propeller mechanism, influenced by the water, has been transmitted to the motor via the turbine coupling.

I claim:

1. A device for transmitting power in a planing boat comprising:

a motor having a supercharging assembly such that said motor has a maximum output at speeds in excess of a supercharging speed at which said supercharging assembly of said motor is actuated;

a gear with a surface water-driving planing-type propeller mechanism mounted on an input shaft which is driven by said motor;

a turbine coupling mounted between said motor and said gear which said turbine coupling can be filled with a fluid to a variable extent from 0 to 100%, said turbine coupling including a pump portion driven by said motor and a turbine portion connected to said input shaft of said gear and variably coupled to said pump portion by the amount of fluid filling said turbine coupling;

a fluid means for emptying said turbine coupling of the fluid when said motor is started so that said turbine portion is substantially disconnected from said pump portion and hence said motor is at least almost fully disconnected from said gear and so that the started motor is accelerated to a first speed in excess of the supercharging speed and for filling said turbine coupling quickly with the fluid while said motor is run at the first speed so that said pump portion is coupled to said turbine portion and hence said motor at the first speed to drive said propeller mechanism, such that the boat is accelerated with the driven propeller mechanism by a substantially maximum motor output until a minimum planing speed is exceeded and thereafter at least one of the first speed of said motor or the filling of said turbine coupling with the fluid is reduced while still maintaining at least the minimum planing speed of the boat.

2. A device for transmitting power in a planing boat as claimed in claim 1 and further including a reduction gear mounted between said turbine coupling and said gear.

3. A device for transmitting power in a planing boat as claimed in claim 2 wherein said reduction gear limits the maximum propeller mechanism speed to 1,000–2,000 rpm.

4. A device for transmitting power in a planing boat as claimed in claim 3 wherein said reduction gear limits the maximum propeller mechanism speed to 1,200 to 1,500 rpm.

5. A device for transmitting power in a planing boat as claimed in claim 2 and further including a reversing gear provided between said turbine coupling and said reduction gear.

6. A device for transmitting power in a planing boat as claimed in claim 5 wherein said reduction gear includes a gear belt coupling mounted between said turbine coupling and said gear.

7. A device for transmitting power in a planing boat as claimed in claim 5 wherein said reversing gear is a torque converter and further including a means for disconnecting said torque converter under the condition that said turbine coupling is completely filled with the fluid.

8. A device for transmitting power in a planing boat as claimed in claim 1 and further including a plurality of units comprising a said motor, an associated said turbine coupling, and a drive coupling, which said units are distributed in a row extending from stern to bow of the boat; and a common output shaft connected to said input shaft of said gear to which said rive couplings are connected.

9. A method of transmitting power in a planing boat from a motor with a supercharging assembly to a gear with a surface water-driving planing-type propeller mechanism, the method comprising the steps of:

mounting a turbine coupling between the motor and the gear which turbine coupling can be filled with a fluid to a variable extend, the turbine coupling including a pump portion driven by the motor and a turbine portion connected to an input shaft of the gear and variably coupled to the pump portion by the amount of fluid filling the turbine coupling;

emptying the turbine coupling of the fluid when the motor is started so that turbine portion is substantially disconnected from the pump portion and hence the motor is at least almost fully disconnected from the gear;

accelerating the started motor to a first speed in excess of a supercharging speed at which the supercharging assembly of the motor is actuated;

filling the turbine coupling quickly with the fluid while the motor is run at the first speed so that the pump portion is coupled to the turbine portion and hence the motor at the fist speed drives the propeller mechanism;

accelerating the boat with the driven propeller mechanism until a minimum planing speed is exceeded; and after the planing speed of the boat is reached, reducing at least one of the first speed of the motor or the filling of the turbine coupling with the fluid while still maintaining at least the minimum planing speed of the boat.

10. A method of transmitting power as claimed in claim 9 wherein said accelerating the motor step includes the step of accelerating the motor substantially to a maximum speed of the motor and said accelerating the boat step is performed while the motor is at the maximum speed, and wherein said filling step includes the step of completely filling the turbine coupling with the fluid so that the turbine coupling when filled completely functions as an inelastic coupling.

11. A method of transmitting power as claimed in claim 9 and further including the step of connecting a reduction gear between the turbine coupling and the gear.

* * * * *